US009614332B2

(12) United States Patent
Curtin et al.

(10) Patent No.: US 9,614,332 B2
(45) Date of Patent: Apr. 4, 2017

(54) MILITARY VEST AND QUICK RELEASE BUCKLE WITH ELECTRICAL CONNECTORS

(71) Applicant: Mystery Ranch, Ltd., Bozeman, MT (US)

(72) Inventors: Jim Curtin, Pittsford, NY (US); Paul Gleason, Bozeman, MT (US)

(73) Assignee: MYSTERY RANCH, LTD., Bozeman, MT (US)

( * ) Notice: Subject to any disclaimer, the term of this patent is extended or adjusted under 35 U.S.C. 154(b) by 0 days.

(21) Appl. No.: 14/793,014

(22) Filed: Jul. 7, 2015

(65) Prior Publication Data

US 2016/0015132 A1 Jan. 21, 2016

Related U.S. Application Data

(60) Provisional application No. 62/021,329, filed on Jul. 7, 2014.

(51) Int. Cl.

| | |
|---|---|
| ***H01R 33/00*** | (2006.01) |
| ***H01R 13/66*** | (2006.01) |
| ***A44B 11/26*** | (2006.01) |
| *H01R 13/627* | (2006.01) |
| *H01R 4/58* | (2006.01) |

(52) U.S. Cl.

CPC ..... *H01R 13/665* (2013.01); *A44B 11/266* (2013.01); *H01R 4/58* (2013.01); *H01R 13/6271* (2013.01); *H01R 13/6275* (2013.01)

(58) Field of Classification Search

USPC ..... 439/37, 352

See application file for complete search history.

(56) References Cited

U.S. PATENT DOCUMENTS

| | | | | |
|---|---|---|---|---|
| 5,279,505 | A * | 1/1994 | Goudreau | G08B 21/22 24/579.09 |
| 5,806,152 | A * | 9/1998 | Saitou | A44B 11/266 24/635 |
| 6,863,539 | B2 * | 3/2005 | Marmaropoulos | H01R 13/6271 280/801.1 |
| 7,008,253 | B2 * | 3/2006 | Szczesny | H01R 13/6335 439/352 |

(Continued)

FOREIGN PATENT DOCUMENTS

| | | | |
|---|---|---|---|
| WO | WO2008055074 | A2 * | 5/2008 |
| WO | 2009151643 | A2 | 12/2009 |

*Primary Examiner* — Tho D Ta

(74) *Attorney, Agent, or Firm* — Husch Blackwell LLP

(57) ABSTRACT

The present invention relates to a buckle system including a male subassembly and female subassembly that are designed to mate with one another. The male subassembly also includes a printed circuit board (PCB) that may mate with an electrical connector within the female subassembly, thus completing a circuit for providing power to an electronic device when the subassemblies are mated. The male subassembly is connected to a cable portion that, when pulled with sufficient force, causes the male subassembly and its PCB to disengage the female subassembly and its electrical connector. The PCB and electrical connector may also be connected within standard side-release male and female subassemblies, respectively, for use in standard side-release buckles.

20 Claims, 11 Drawing Sheets

(56) References Cited

U.S. PATENT DOCUMENTS

| | | | | |
|---|---|---|---|---|
| 7,364,465 | B2 * | 4/2008 | Wu | H01R 13/6275 439/607.41 |
| 7,445,485 | B1 * | 11/2008 | Wu | H01R 13/514 439/160 |
| 7,448,874 | B2 * | 11/2008 | Willis | G01K 1/02 374/E1.002 |
| 8,235,745 | B1 * | 8/2012 | Armstrong | H01R 13/633 439/344 |
| 8,267,713 | B2 * | 9/2012 | Wu | H01R 13/6275 439/352 |
| 8,376,759 | B2 * | 2/2013 | Debock | H01R 12/775 439/37 |
| 8,475,199 | B2 * | 7/2013 | Wang | H01R 13/6275 439/160 |
| 8,740,637 | B2 * | 6/2014 | Wang | H01R 13/6335 439/352 |
| 8,747,141 | B2 * | 6/2014 | Crain | H01R 13/6272 439/258 |
| 2007/0093707 | A1 | 4/2007 | Noguchi | |
| 2009/0111310 | A1 | 4/2009 | Burke et al. | |
| 2010/0008090 | A1 | 1/2010 | Li et al. | |
| 2010/0313392 | A1 | 12/2010 | Anscher | |
| 2013/0237794 | A1 | 9/2013 | Nishiyama | |

* cited by examiner

MILITARY VEST AND QUICK RELEASE BUCKLE WITH ELECTRICAL CONNECTORS

CROSS-REFERENCE TO RELATED APPLICATIONS

This application claims the benefit of U.S. Provisional Application No. 62/021,329, filed Jul. 7, 2014, which is hereby incorporated by reference in its entirety.

BACKGROUND OF INVENTION

Nearly every soldier wears body armor to protect themselves from enemy fire during combat. For example, the body armor may be a tactical vest such as an Improved Outer Tactical Vest (IOTV). Such vests may be compatible with other protective components including yokes and collars, throat protectors, and groin protectors. The body armor vests protect soldiers from enemy gunfire, and also serve as a means for carrying combat gear. The vests of today are often designed to allow a great deal of gear to be attached to them, including firearms, ammunition, knives, and electrical devices such as radios. When radios and other electrical devices are associated with the body armor, a soldier must generally carry batteries and cables within their body armor to support and provide power to the various electrical devices. It is not uncommon for soldiers to carry more than ninety pounds on their back including the body armor and its associated firearms, ammunition, knives, and electrical devices.

IOTVs are required to include a quick release system that allows a soldier to pull a strap located on the IOTV in case of an emergency. Pulling the strap will cause a buckle, or a series of buckles, or various loops and cables holding the vest together, to release. The vest will then fall off of the soldier's body, freeing the soldier of the vest. For example, if a soldier falls in water, the soldier may pull the strap and to release the vest and its excess weight, in order to more easily swim to safety. In another example, a soldier may experience a medical emergency requiring another soldier or a health care provider to access the soldier's torso region. In that scenario, it would be necessary to provide a quick release system that allows another soldier to quickly discard the injured soldier's vest to provide medical care.

Presently, a number of systems exist that aim to facilitate the release of the vest in such scenarios. In one system, a long cable weaves through the vest and holds a series of loops in place that further hold the vest in place. When that cable is pulled, the loops separate and the vest falls off. Those vests, however, do not include a means for releasing the electrical connectors and cables associated with the electronic devices the soldier carries. Currently, when the cable is pulled, the vest can hang up on the various electrical connectors and cables until there's enough force in the system to pull the electrical connector apart. Typically the electronic connectors associated with the cables of the vests are designed to separate at ten to fifteen pounds of pull force. This is known in the field as a two stage breakaway.

When the electronics associated with the vest fail to break away when the cable is pulled, the various cables and connectors could cause the same problems that the breakaway vest aims to solve. Even when quick release systems are not of immediate concern, putting on or taking off such a vest may be more difficult due to the various electrical cables that span various connection points within the vest. The electronic cables could get caught up and prevent the vest from being quickly removed during an emergency, or simply during normal donning and removal. Disconnecting the electrical cables could be especially difficult when a soldier is in water, and in a medical emergency, the time required to disconnect the electrical cables may be precious time needed to tend to an injured soldier.

Thus it is desirable to provide a system allows for simultaneously disconnecting electrical connections and associated cables along with various connection points of the best. In emergency situations, such a system would allow the vest and its heavy components to fall off a soldier, and would disconnect electrical cables and connections in the process. In providing such a system, the body armor vest should still capably protect the soldier and provide a means for transporting gear that is crucial to the soldier in combat times.

SUMMARY OF INVENTION

The present invention relates to a buckle, which may be used in a body armor vest, which incorporates electrical connections for electrical connectors and cables associated therewith. For example, such a buckle may be used by the military as a buckle, or as a quick release buckle for causing the vest to uniformly break apart and fall off during emergencies. Thus, the electrical connection may break apart at the same time as the mechanical buckle. In a quick release vest, when a cable is pulled, the vest may break apart into a plurality of sections and fall to the ground while the electrical connections are also broken and the cables associated therewith are further broken, causing the electrical cables to disconnect and be out of the way of the vest breaking into its plurality of sections.

The present invention may be broadly described as a buckle including an electrical connection. The electrical connection may preferably be integrated into a quick release buckle (particularly for uses associated with quickly causing the vest to break apart and fall off during emergencies), or it may alternatively be integrated into a traditional buckle that also may require that electrical connections be broken at the same time as mechanical connections.

In a quick release mechanism known in the art, a cable associated with the male subassembly of the buckle mechanism is attached at one end to an actuator of the buckle and its other end is within reach of a user. When the user pulls the cable, the cable causes the actuator to pull inward. This causes outer legs of the male subassembly to be pulled inward, allowing the male subassembly is disengaged from the female subassembly. This may occur with a single buckle, or with a number of buckles, and preferably causes the vest or other apparel to fall apart into sections. The present invention further preferably includes an electronic assembly within the male and female subassemblies that may disengage from one another when the buckle is opened.

The male subassembly further comprises an electronic assembly where one or more printed circuit board (PCB) elements may be positioned and located. The PCB elements allow an electronic device associated with the vest, body armor, or other apparel to receive power via the PCB elements. The PCB elements are preferably placed between an upper plate and lower plate which are attached to the male subassembly, the upper and lower plates forming a cover unit for protecting and housing the PCB elements therebetween. Such PCB elements may include flexible PCB placed between two rigid PCBs. In one embodiment, a rigid PCB is secured to the end portion of the lower plate and extends from the cover unit so as to mate with an electrical connector associated with the female subassembly when the buckle is buckled. The female subassembly further comprises a connector which may be fixedly mounted at the rear throat portion of the female subassembly. The rigid PCB extending from the end portion of the male subassembly and connector of the female subassembly form a complete circuit when they are connected when the male and female subassemblies are connected as the buckle is buckled.

Because the rigid PCB and connector may be fixedly mounted to the male and female subassemblies, respectively, when the buckle is disengaged, the rigid PCB and connector further disengage as both remain attached to their respective subassemblies. Thus, should a soldier need to quickly remove his quick-release body armor, the soldier can use the same cable used to break the mechanical buckle connections to break the electrical connections as well.

The present invention also includes a second embodiment for use in a standard side-release buckle. In this embodiment, the buckle's male and female subassemblies are released by manually pushing outer locking elements of the male subassembly inwards to disengage the outer locking elements from the slots associated with the female subassembly in a manner well-known in the art. In the present invention, however, an electronic assembly similar to that described for the quick release embodiment is further included in the buckle. The male subassembly includes at least one PCB element in a central portion that is in communication with an electronic device needing power. The male subassembly includes at least one rigid PCB element extending from its end portion for mating with a connector positioned and located in the rear throat portion of the female subassembly. In a substantially similar process, when the subassemblies are disengaged in the well-known manual process described above, the rigid PCB elements further disengage from the connector and the electrical connection is interrupted. An alternative embodiment to the standard release buckle is further described that modifies the standard buckle arrangement to be a quick release buckle.

DESCRIPTION OF THE SEVERAL VIEWS OF THE DRAWINGS

In the accompanying drawings, which form a part of the specification and are to be read in conjunction therewith in which like reference numerals are used to indicate like or similar parts in the various views.

DETAILED DESCRIPTION OF THE INVENTION

The present invention is directed generally toward a buckle, or buckle system, which may be used in connection with a military body armor vest, wherein the buckle system includes an electrical connection located within the buckle that may be broken simultaneously with the mechanical release of the buckle system, thus breaking the electrical connections used to power and service the electrical components within the vest. By disconnecting the electrical components and the connections and cables associated therewith, the vest may more easily break apart and fall to the ground. While the buckle is preferably made for a quick release vest, the present invention may also be used in a more traditional, standard side-release buckle. Both embodiments, one for a quick release and one for a standard buckle, are described herein.

Figure 1:
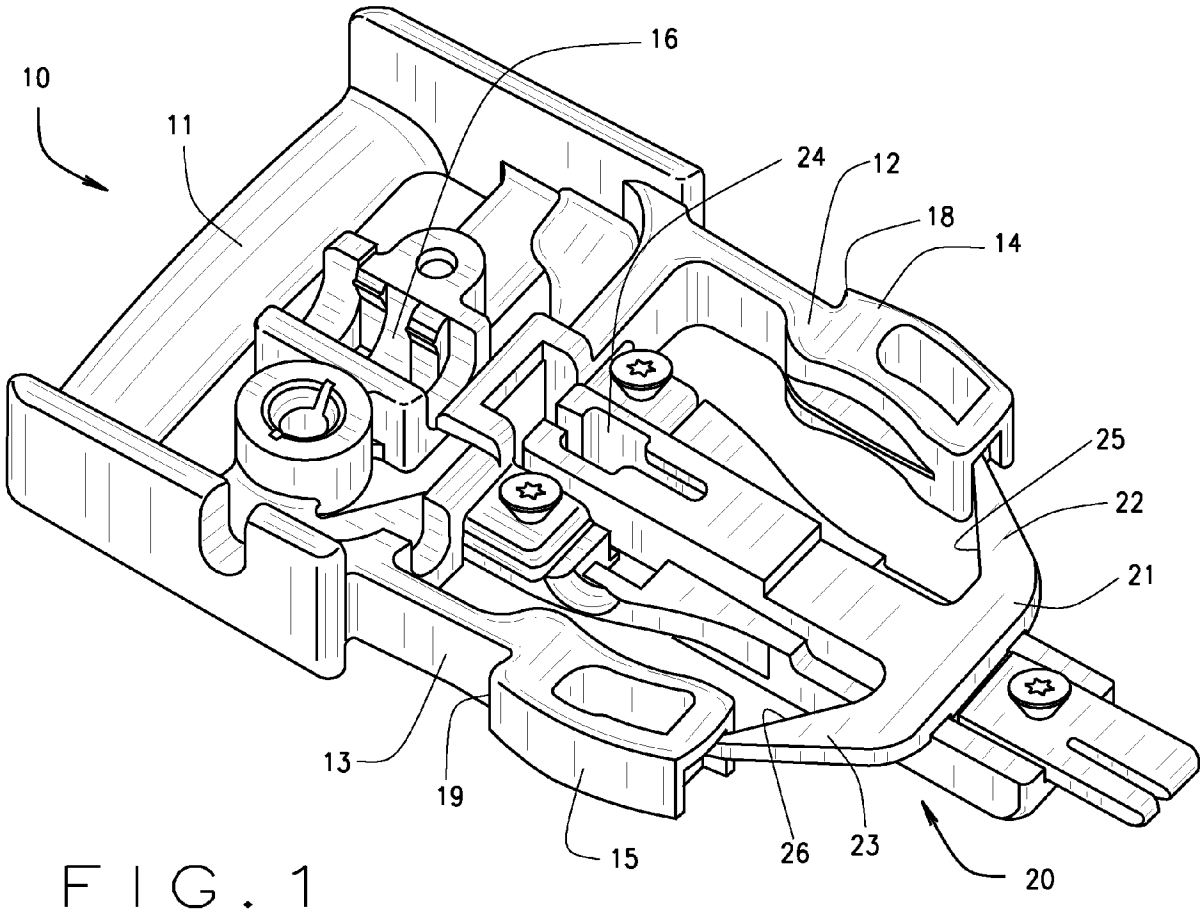
FIG. 1 is a perspective view of a quick release male subassembly for use with the quick release buckle constructed in accordance with the teachings of the present invention.

FIG. 1 is a perspective view of a quick release male subassembly 10 according to an embodiment of the present invention. The male subassembly 10 is configured to be selectively mated with a female subassembly (discussed below in connection with FIGS. 4 and 5, for example) to form a quick release buckle (described in greater detail below in connection with FIGS. 6-9). In the embodiment illustrated in FIG. 1, male subassembly 10 is preferably substantially similar to the male subassembly described in U.S. Pat. No. 8,196,273. Male subassembly 10 preferably includes a base 11 and two locking legs 12, 13. Each locking leg 12, 13 has a locking element 14, 15, on its respective end. Extending from base 11 is a central leg 16, through which a cable (not illustrated) may extend. The cable may be further connected to a release assembly 20, which may be formed by a separate piece from male subassembly 10. The cable may be further surrounded by a cable sheath (not shown) outside male subassembly 10 so the cable sheath can be attached to a separate structure located within reach of a user, and the cable can slide within the cable sheath to operate the buckle assembly described.

Release assembly 20 preferably includes an actuator 21 and two arms 22, 23 extending back toward base 11 of male subassembly 10. Extending down from actuator 21 is a cable guide 24. The cable guide 24 is associated with the central leg 16 when a cable runs therethrough to the cable guide 24. In this regard, the cable may extend through central leg 16 and attach to cable guide 24 of release assembly 20.

Figure 4:
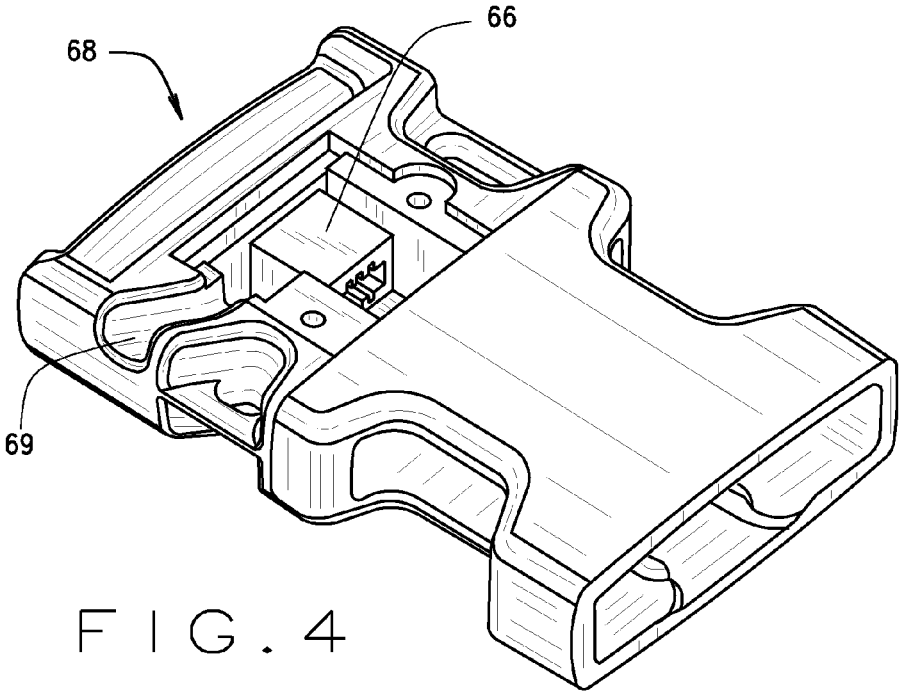
FIG. 4 is a bottom perspective view of a quick release female subassembly for selective mating with the male subassembly of FIG. 1.
Figure 5:
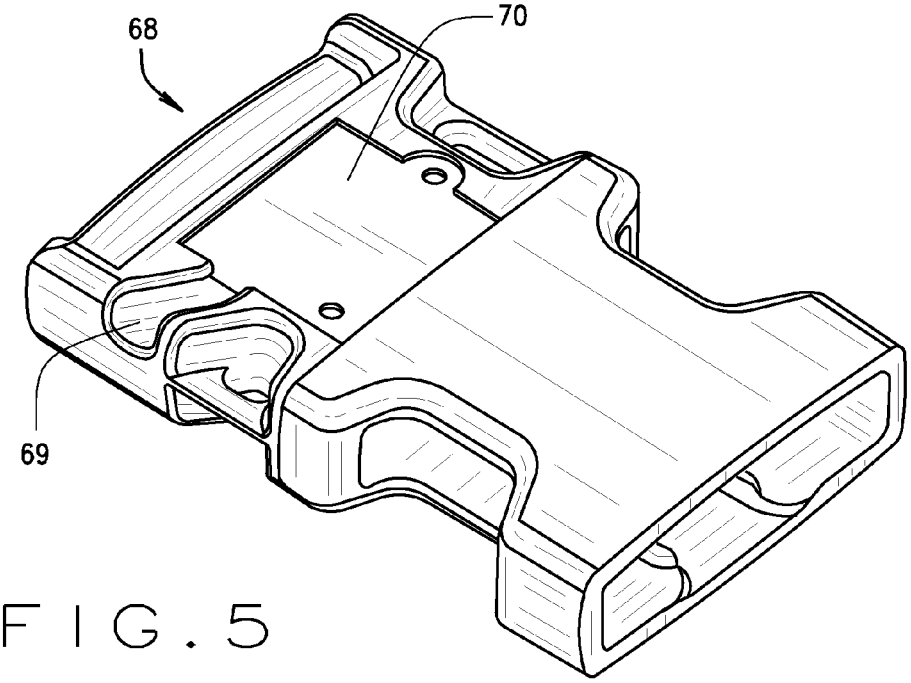
FIG. 5 is a bottom perspective view of the female subassembly of FIG. 4 further including a protective plate.
Figure 7:
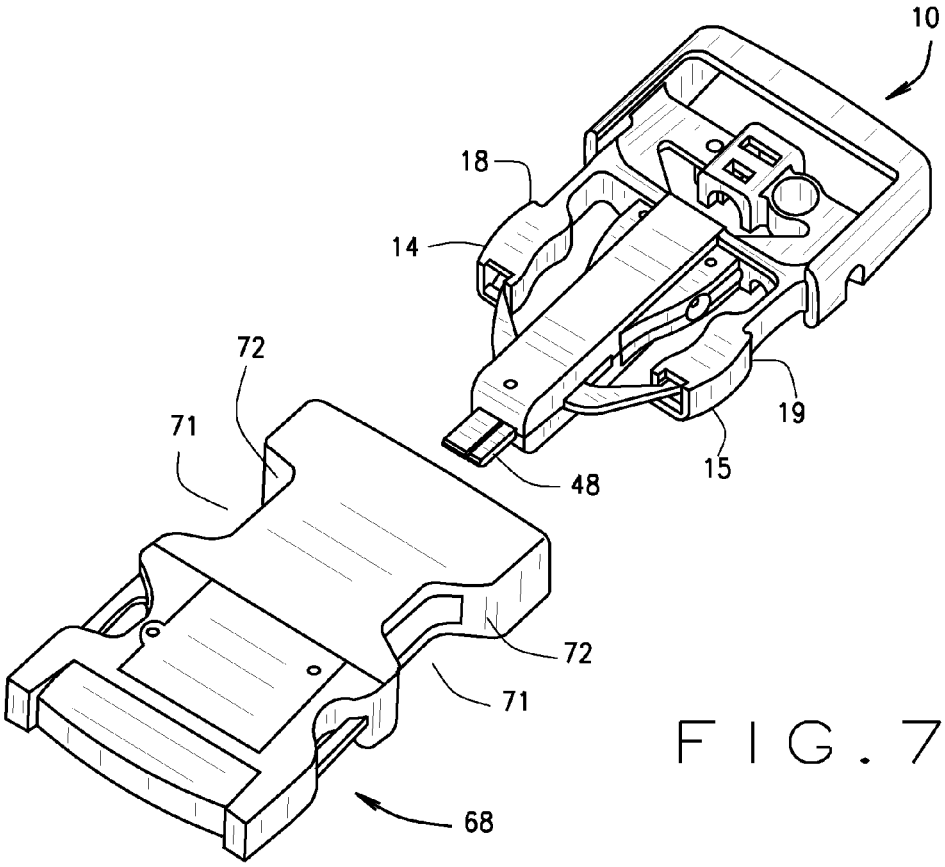
FIG. 7 is a bottom perspective view of the male subassembly and female assembly aligned with one another for selective engagement.

Arms 22, 23 of release assembly 20 preferably have a slanted interior surface 25, 26 which is angled outward toward the ends of arms 22, 23, respectively, so that the inner contour of release assembly 20 widens as it extends away from actuator 21. Locking elements 14, 15 each have a curved structure that widens from the tip to the bottom of locking elements 14, 15, which may terminate at end portions thereof at ledges 18, 19, respectively. Ledges 18, 19 may secure locking elements 14, 15 within locking slots of a corresponding female buckle portion, such as shown in FIGS. 4, 5, and 7.

Figure 2:
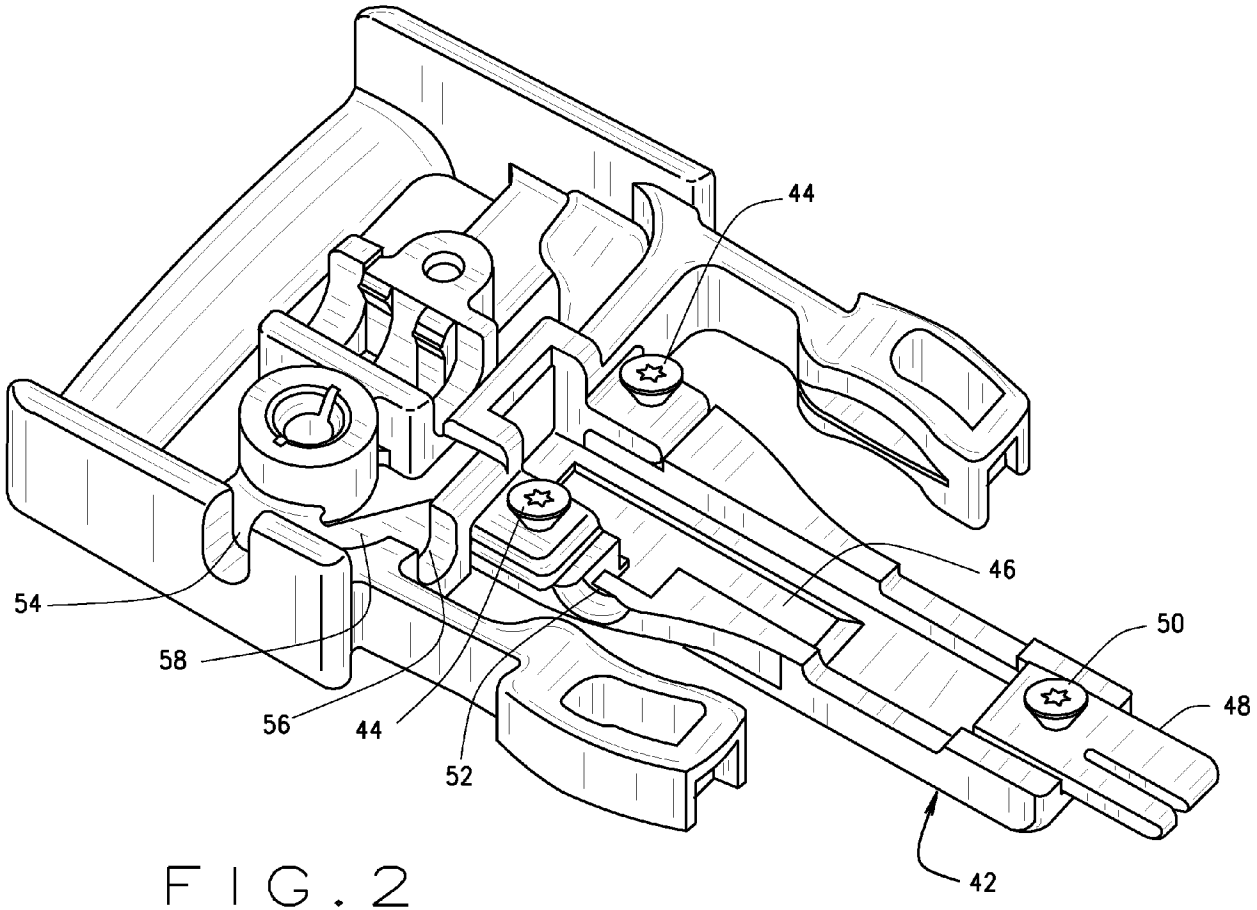
FIG. 2 is a perspective view of the male subassembly of FIG. 1 wherein its release assembly has been removed to better illustrate the components therein.

In this embodiment, male subassembly 10 further comprises an electronic assembly. FIG. 2 illustrates male subassembly 10 with the release assembly 20 removed. With the release assembly 20 removed, central prong element, or lower plate 42, is visible. Lower plate 42 preferably resides below and may mate with cable guide 24, as well as release assembly 20, as illustrated in FIG. 1. Lower plate 42 is fastened to the male subassembly 10 in the preferred embodiment by screws 44. Lower plate 42 preferably includes a cavity 46 in which at least one flex printed circuit board ("PCB") (not illustrated) may be secured. Cavity 46 is preferably located below release assembly 20 (when attached to male subassembly 10) and located above lower plate 42. The flex PCB is a PCB commonly known throughout the art. The flex PCB is preferably made of plastic and is designed to be flexible such that it can fit within cavity 46. It may be made of FR-4 Epoxy or any other conductive circuit board that may fit in cavity 46. Flex PCB of cavity 46 is preferably connected at a distal end to a rigid PCB 48. Rigid PCB 48 is preferably fastened to lower plate 42, and in the illustrated embodiment, a screw 50 fastens rigid PCB 48 to lower plate 42, though other means for fastening rigid PCB 48 to the lower plate 42 are further envisioned. Rigid PCB 48 is preferably fixedly mounted to lower plate 42, however, such that it is not moved when actuator 21 moves following an actuating event.

The flex PCB and rigid PCB 48 may be connected to one another in a manner commonly known throughout the art so long as the connection allows for electrical communication therebetween. Rigid PCB 48 is preferably positioned and located such that when male subassembly 10 and a female assembly are mated, rigid PCB 48 also may mate with a connecting mechanism for ensuring electrical communication across the fastened quick release buckle, as will be described herein below.

Lower plate 42 may further comprise a semi-circular aperture 52 in a side portion of plate 42. Semi-circular aperture 52 allows a cable harness in communication with an electrical device (e.g., a radio, battery) to pass through lower plate 42 such that the cable harness is further in electrical communication with rigid PCB 48 via the flexible PCB. Recess 54 in a side portion of male subassembly 10 further allows the cable harness to pass through the male subassembly 10, and its components therein, without affecting the ability of the buckle to fasten. A separate recess 56 is preferably located between the lower plate 42 and the recess 54, and a channel 58 is positioned between recesses 54, 56 such that the cable harness may be secured within the channel such that it is out of the way when the buckle is fastened and unfastened. Lower plate 42 may also include a partial gap (not illustrated) located on its front tip portion positioned and located for rigid PCB 48 to pass there through in a manner described herein below.

Figure 3:
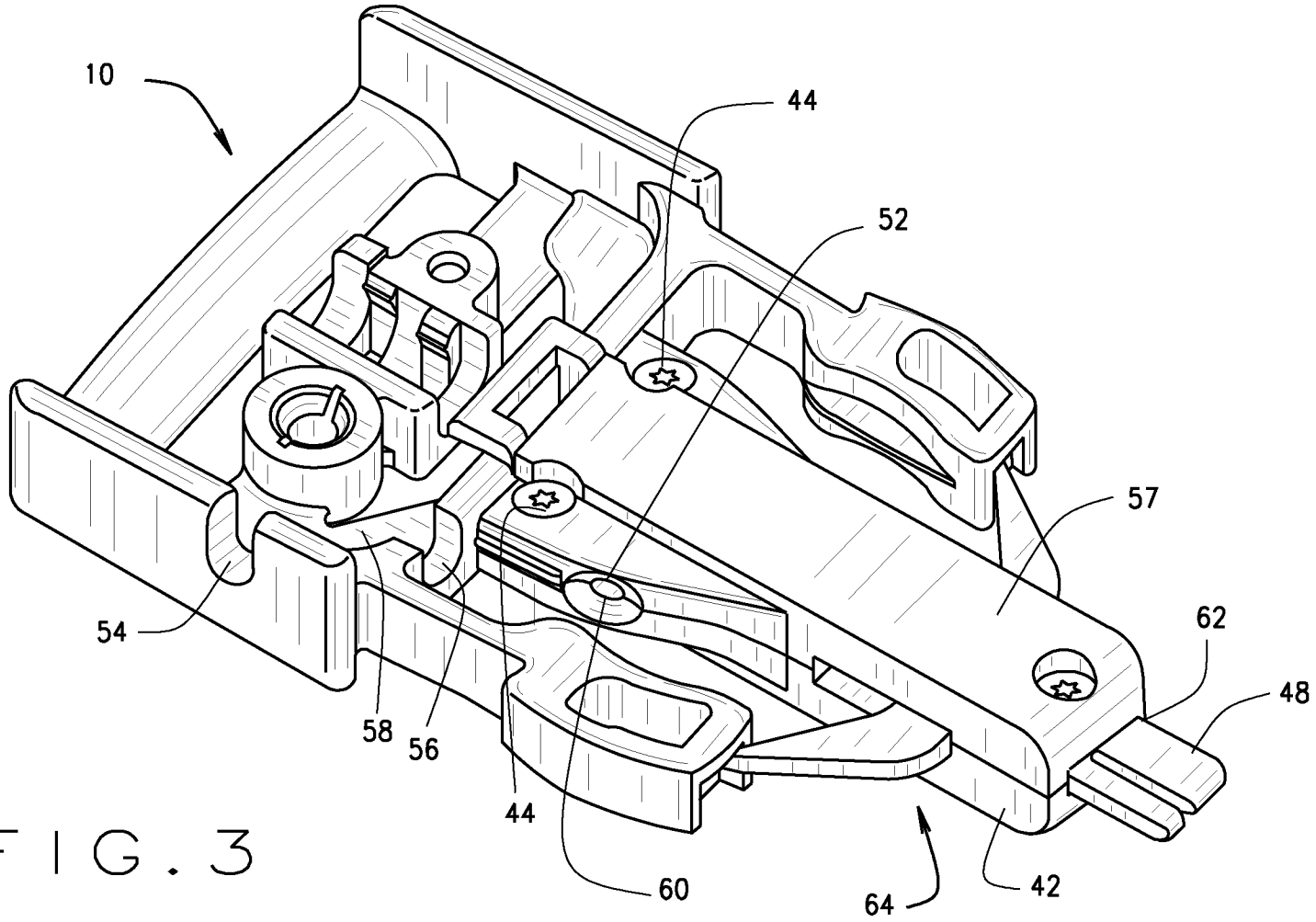
FIG. 3 is a perspective view of the male subassembly of FIG. 1 further including a cover unit attached thereto.

FIG. 3 illustrates male subassembly 10 when upper plate 57 is attached to male subassembly 10. Upper plate 57 may be substantially similar to lower plate 42. Thus when plates 42, 57 abut one another they are selectively mateable with one another. Screws 44 used to attach lower plate 42 to male subassembly 10 may be used to further attach upper plate 57 to lower plate 42, though other mechanisms known throughout the art for attaching upper plate 57 to lower plate 42 are contemplated herein.

Upper plate 57 may also include a semi-circular aperture 52. When upper and lower plates 57, 42 are attached in the method described above, apertures 52 of upper and lower plates 57, 42 align and abut one another such that a circular aperture 60 forms, as illustrated in FIG. 3.

Thus, when plates 57, 42 are attached within male subassembly 10, a cable harness in communication with the flex PCB and rigid PCB 48 may pass through aperture 60, as well as recesses 54, 56, via channel 58, to prevent the cable harness from interfering with the buckle's fastening.

Upper plate 57 also preferably includes a partial gap (not illustrated), such that when upper and lower plates 57, 42 are selectively attached in the manner described above, the partial gaps align and abut one another such that gap 62 is formed. As shown in FIG. 3, extending from gap 62 is rigid PCB 48. Therefore, when plates 57, 42 are attached, the flexible PCB is contained therein, and rigid PCB 48 extends through gap 62 and extends therefrom such that it may selectively mate with an electrical receiver of a female subassembly, as described below.

Plates 57, 42 form a cover unit 64 that protects the electronic components found therein (e.g., the flexible PCB and cable harnesses) from the wear and tear the components may be exposed to during combat. Cover unit 64 may include the flexible PCB therein. Rigid PCB 48 may extend from cover unit 64 via gap 62 for selective engagement with a corresponding electronic component, which may be but should not be limited to a Samtec® connector 66 attached to the rear portion of a quick release female subassembly 68, shown in FIG. 4 which illustrates a top perspective view of the bottom of female subassembly 68. The bottom portion of female subassembly 68 further may include a channel 69 through which a separate cable harness in electrical communication with connector 66 may be placed so as not to interfere with the buckle connection.

Figure 8:
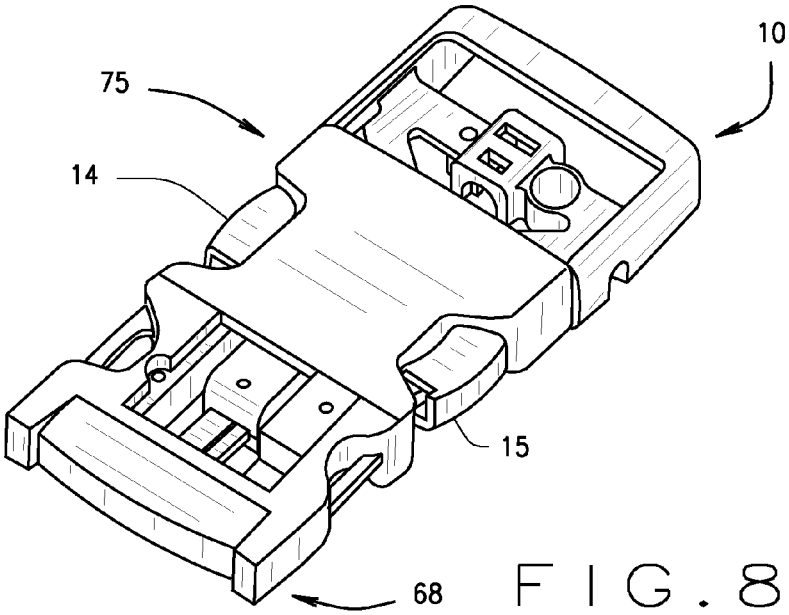
FIG. 8 is a bottom perspective view of the male subassembly and female subassembly selectively engaged with one another.
Figure 9:
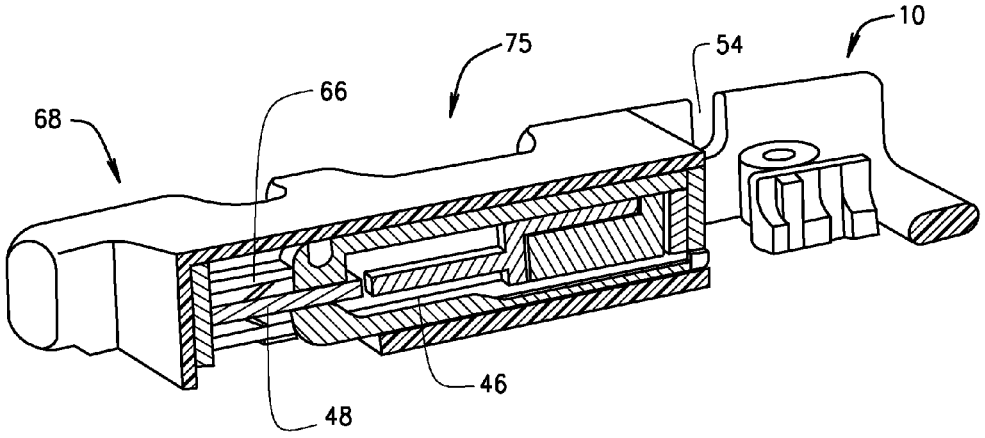
FIG. 9 is a cross-section view of the selectively engaged subassemblies of FIG. 8.

Female subassembly 68 is preferably a subassembly commonly known throughout the art, wherein female subassembly 68 is configured for selective engagement with male subassembly 10 to form a quick release buckle when the subassemblies 10, 68 are engaged with one another (illustrated in FIGS. 8 and 9). Female subassembly 68 is configured substantially similarly to female buckle portions on standard side-release buckles, except that extra room is made to accommodate release assembly 20 inside its cavity for receiving male subassembly 10.

As previously described, female subassembly 68 preferably includes a connector 66 for selectively mating with rigid PCB 48 in order to maintain the electrical communications therebetween. In the present embodiment, connector is accessible via the bottom portion of female subassembly 68. FIG. 5 illustrates bottom portion of female subassembly 68 wherein a protective plate 70 has been placed over connector 66 so as to protect connector 66 contained below plate 70 from the wear and tear associated with combat and other vigorous use. In the illustrated embodiment, plate 70 is screwed to female subassembly 68, though other means for fastening plate 70 to subassembly 68 are herein contemplated.

Figure 6:
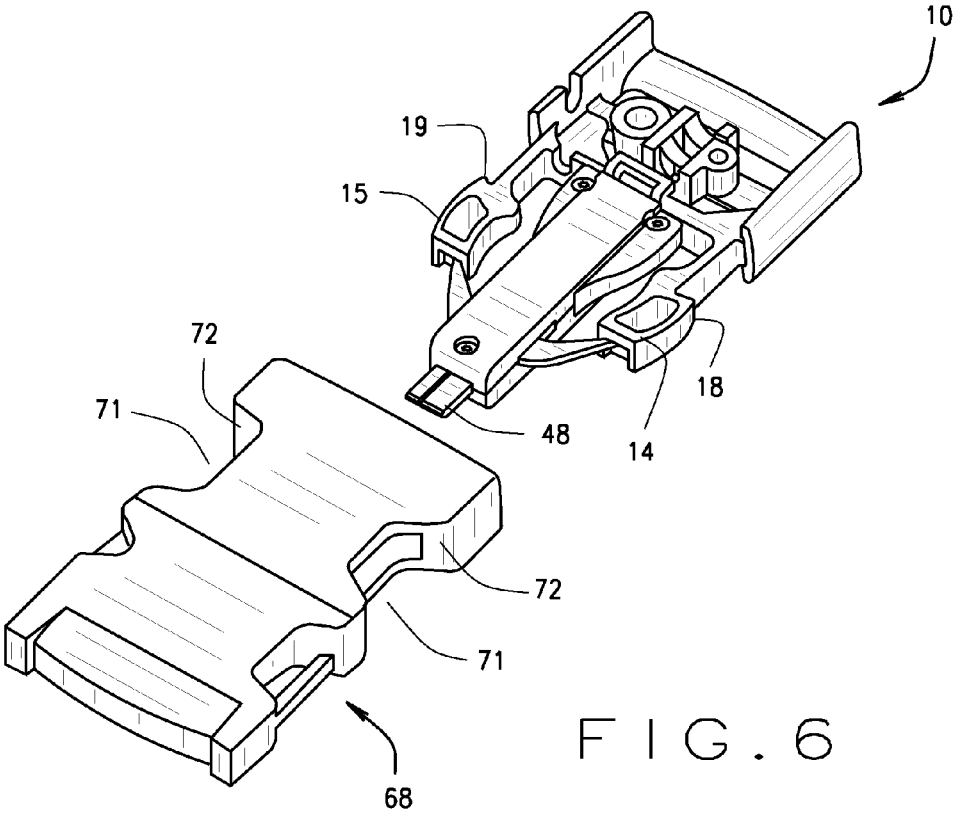
FIG. 6 is a top perspective view of a male subassembly and female subassembly aligned with one another for selective engagement.

FIG. 6 illustrates a top perspective view of male subassembly 10 and female subassembly 68 aligned for engagement, and FIG. 7 illustrates a bottom perspective view of the same. Thus, in operation, when subassemblies 10, 68 are engaged with one another by placing male subassembly 10 inside of female subassembly 68 in a manner long-used and widely known in the art, locking elements 14, 15 pinch inwardly until locking slots 71 of female subassembly 68 receive locking elements 14, 15. As male subassembly 10 is further inserted into female subassembly 68, locking elements 14, 15 pop through locking slots 71, and ledges 18, 19 of locking elements 14, 15 engage ledges 72 of locking slots 71. FIG. 8 illustrates a bottom perspective view of subassemblies 10, 68 engaged with one another, and FIG. 9 illustrates a cross-sectional view of the same engagement from a top perspective view. When subassemblies 10, 68 are engaged with one another in the described manner, quick release buckle 75 may be formed.

In the same operation, and at approximately the same time male subassembly 10 is inserted into female subassembly 68, rigid PCB 48 is preferably received by connector 66. Thus, when subassemblies 10, 68 are engaged, rigid PCB 48 and connector 66 also are engaged. When rigid PCB 48 and connector 66 are engaged, an electrical connection is formed therebetween, and a complete circuit is formed such that an electronic device such as a radio on one side of buckle 75 may be in electrical communication with a power source on the other side of the buckle.

In this embodiment, buckle 75 should be able to be quickly disconnected, as well as the electrical connection formed between the rigid PCB 48 and connector 66. Thus, when a cable associated with and passing through male subassembly 10 is pulled, release assembly 20 is pulled toward base 11 and presses against locking elements 14, 15 of male subassembly 10. Slanted inner surfaces 25, 26 slide along the curved outer surface of locking elements 14, 15 and press locking elements 14, 15 inward as the inner contour of release assembly 20 narrows toward the top. Once release assembly 20 has been fully lowered, locking legs 12,13 have been sufficiently pressed inward to allow locking elements 14, 15 to clear locking slots 31 of female subassembly 68. At this point, male subassembly 10 is released from female subassembly 68 and is pulled out by the force applied to the cable associated with male subassembly 10.

At approximately the same time that male subassembly 10 disengages from female subassembly 68 in the process described above, rigid PCB 48 disengages from connector 66. This disengagement is preferably driven by subassemblies 10, 68 disengaging, not by the release mechanism described in detail above. Because rigid PCB 48 is fixedly mounted to lower plate 42, and connector 66 is releasably attached within female subassembly 68, when subassemblies 10, 68 are separated, rigid PCB 48 preferably stays attached to lower plate 42, and connector 66 stays attached within female subassembly 68. Rigid PCB 48 is preferably removed from within connector 66 when subassemblies 10, 68 are disengaged via the described quick release mechanism.

Figure 10:
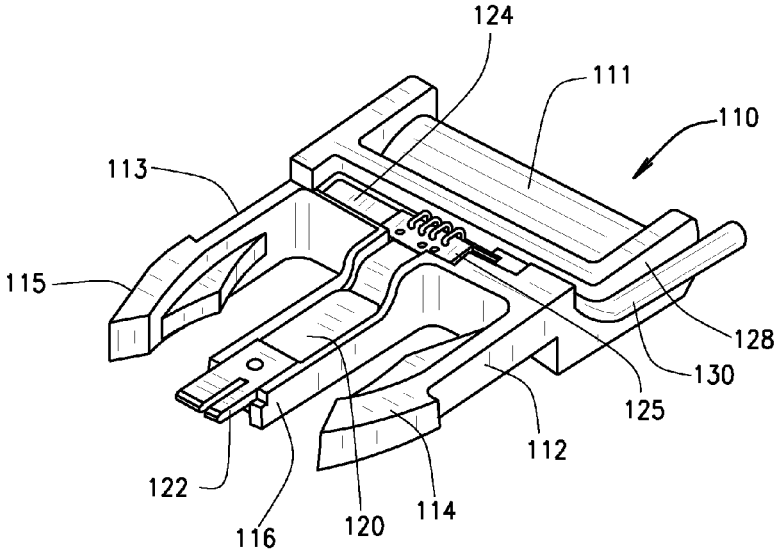
FIG. 10 is a perspective view of a standard male subassembly for use with the standard buckle constructed in accordance with the teachings of the present invention.

The present invention, however, is not limited to use for a quick release buckle, such as quick release buckle 75. Alternatively, the invention may be utilized in a slightly modified standard buckle commonly known in the field. FIG. 10 illustrates a standard male subassembly 110. Male subassembly 110 is preferably configured to be selectively mated with a female subassembly to form a modified standard side-release buckle in a method described in greater detail below. In the illustrated embodiment, male subassembly 110 has a base 111 and two outer locking legs 112, 113. Each locking leg 112, 113 has a locking element 114, 115, on its respective end. Extending from base 111 is a central prong element or leg 116 that includes a cavity 118 (not illustrated) extending along the length of leg 116 where flexible PCB 120 and rigid floating PCB 122 may reside. Flexible PCB 120 and rigid floating PCB 122 are preferably located within cavity 118 in the embodiment illustrated in FIG. 10. Rigid floating PCB 122 is preferably mounted to the male subassembly 110 in the present embodiment in a somewhat loose fashion, though an embodiment wherein the rigid floating PCB 122 is fixedly mounted to male subassembly 110 is contemplated.

Male subassembly 110 further preferably includes a second transverse cavity 124 positioned and located adjacent base 111 near the rear portion of male subassembly 110. Cavity 124 may be sized and positioned to receive a rigid PCB 125 in the preferred embodiment illustrated in FIG. 10. Rigid PCB 125 may also be loosely or fixedly mounted to male subassembly 110 within cavity 124. Cavity 124 may further include a channel portion 128 for allowing a cable harness 130 to pass through such that harness 130 does not interfere with the fastening or unfastening of the buckle.

In operation, an electronic device that requires a power supply is in electrical communication with cable harness 130. Cable harness 130 is in turn preferably in electrical communication with rigid PCB 125, and rigid PCB 125 is in electrical communication with flexible PCB 120 which may be located within cavity 118 of central leg 116. Flexible PCB 120 is preferably in electronic communication with rigid floating PCB 122. Other electronic communication wirings, cables, and circuit board combinations that would be foreseeable to a person having ordinary skill in the art are also foreseeable so long as electronic communication is provided therebetween the external device needing power and rigid floating PCB 122.

Rigid floating PCB 122 is positioned and located such that when male subassembly 110 and a female assembly are mated, rigid floating PCB 122 also mates with a connecting mechanism for ensuring electrical communication across the fastened quick release buckle, as will be described herein below.

Figure 11:
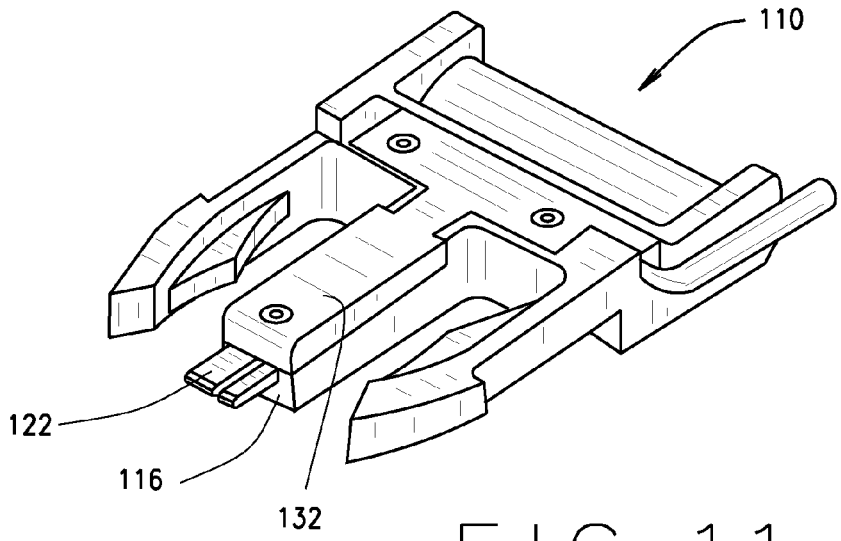
FIG. 11 is a perspective view of the male subassembly of FIG. 10 further including a cover plate attached thereto.

FIG. 11 illustrates male subassembly 110 of FIG. 10 wherein the subassembly further includes a cover plate 132. In the illustrated embodiment, cover plate 132 is fastened to male subassembly 110 via screws, though other foreseeable means for fastening cover plate 132 are contemplated herein. When cover plate 132 is attached, central leg 116, cavity 124, and channel portion 128 are all covered. Such an arrangement helps to protect the electronic components contained therein from being damaged during the wear and tear of combat and routine use.

Figure 12:
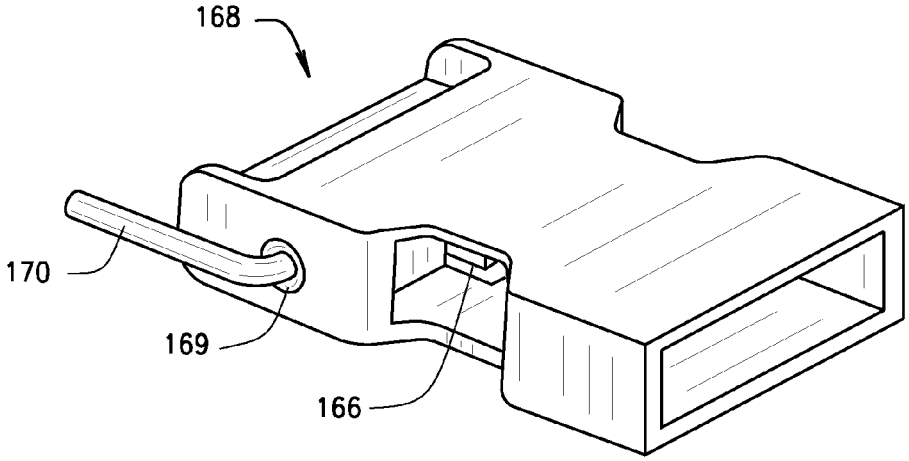
FIG. 12 is a perspective view of a standard female subassembly for selective mating with the male subassembly of FIG. 10.
Figure 13:
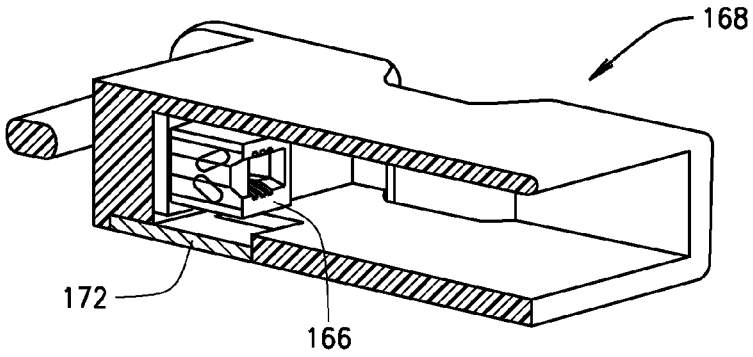
FIG. 13 is a cross-sectional view of the female subassembly of FIG. 12.
Figure 14:
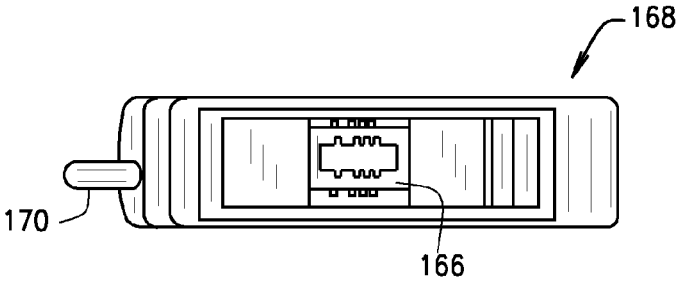
FIG. 14 is a front elevation view of the female subassembly of FIG. 12 and the connector contained therein.

When cover plate 132 is attached to male subassembly 110, rigid floating PCB 122 may extend from central leg 116 for selective engagement with a corresponding electronic component, (connector 166 shown in FIGS. 13 and 14), attached to the rear portion of a female subassembly 168. A top perspective view of female subassembly 168 is illustrated in FIG. 12. A side portion of female subassembly 168 preferably includes an aperture 169 through which a cable harness 170 in communication with connector 166 may pass through so as not to interfere with the buckle connection Female subassembly 168 is a subassembly commonly known throughout the art, wherein female subassembly 168 is designed for selective engagement with male subassembly 110 to form a standard side-release buckle when subassemblies 110, 168 are engaged with one another. Female subassembly 168 is preferably configured substantially similarly to female buckle member portions on standard side-release buckles, except that subassembly 168 hereof includes aperture 169. Other minor modifications are also foreseeable. As previously described, female subassembly 168 includes a connector 166 (shown in FIGS. 13 and 14) that is for selectively mating with rigid floating PCB 122 in order to maintain the electrical communications therebetween. In the present embodiment, connector 166 is a Samtec® connector, although other connectors are contemplated that facilitate an electrical communication with an electrical component located within male subassembly 110. In the present embodiment, connector 166 may be accessed through the bottom portion of female subassembly 168. FIG. 13 illustrates a cross-section view cut along the longitudinal axis of female assembly 168 that shows connector 166, as well as the bottom portion of female subassembly 168 wherein a protective plate 172 has been placed beneath connector 166 so as to protect connector 166 from the wear and tear associated with combat and routine use. In the present embodiment, plate 172 is screwed to female subassembly 168, though other means for fastening plate 172 are herein contemplated. FIG. 14 further illustrates connector 166 associated with female subassembly 168 in a view looking down the throat of female subassembly 168.

Figure 15:
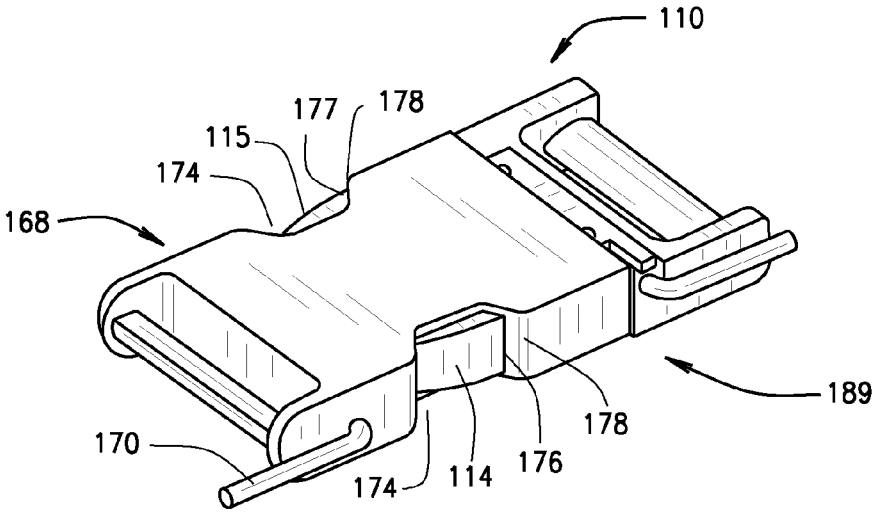
FIG. 15 is a perspective view of the male subassembly of FIG. 10 selectively mated with the female subassembly of FIG. 12.

FIG. 15 illustrates a perspective view of male subassembly 110 and female subassembly 168 selectively engaged with one another. In operation, when subassemblies 110, 168 are engaged with one another by means of placing male subassembly 110 inside of female subassembly 168, locking elements 114, 115 are pinched inwardly until locking slots 174 of female subassembly 168 receive and engage locking elements 114, 115. As male subassembly 110 is further inserted into female subassembly 168, locking elements 114, 115 pop through locking slots 174, and ledges 176, 177 of locking elements 114, 115 engage ledges 178 of locking slots 174.

Figure 16:
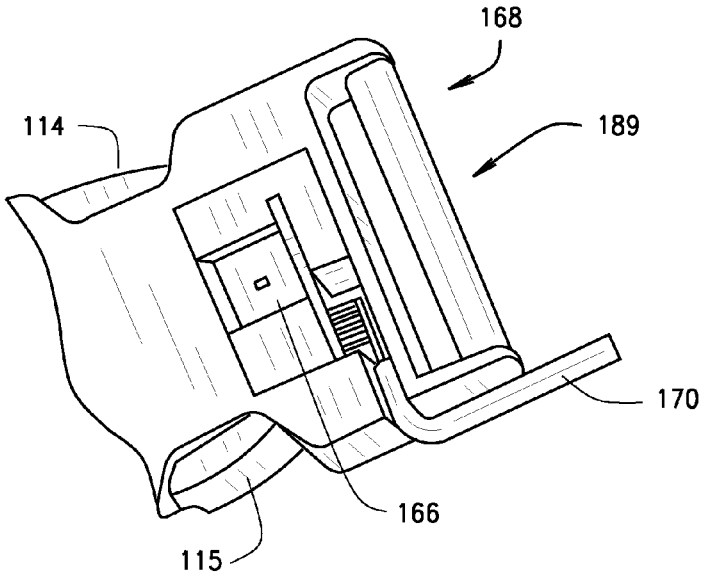
FIG. 16 is an enlarged bottom perspective view of the female subassembly when it is mated with the male subassembly, as illustrated in FIG. 15.
Figure 17:
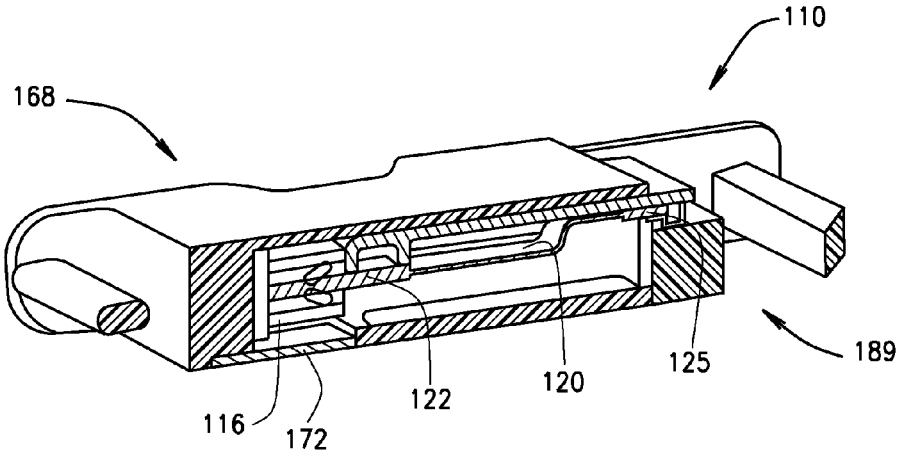
FIG. 17 is a perspective view of a cross-section of the mating of the male subassembly and female subassembly, the cut taken along the longitudinal axis of the mated subassemblies.
Figure 18:
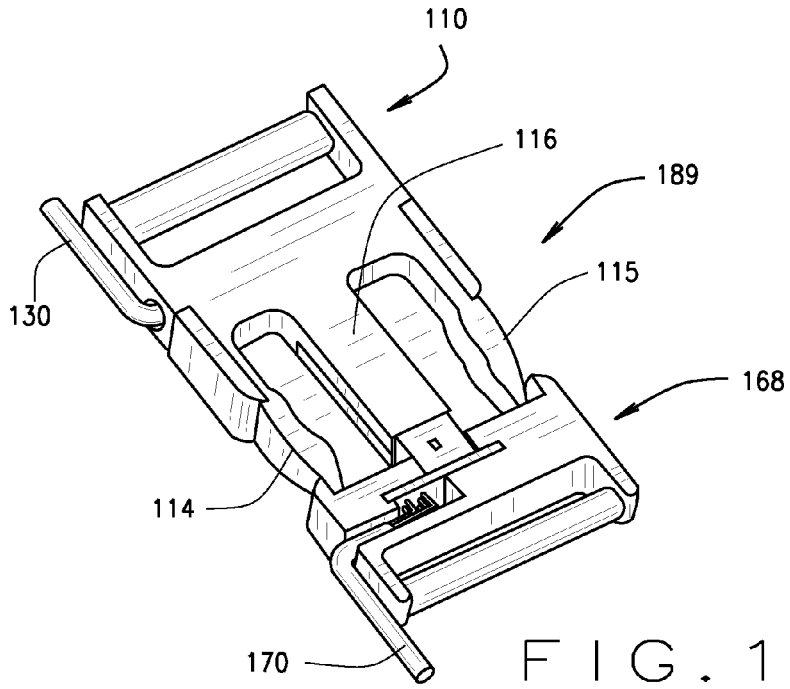
FIG. 18 is a perspective view of a cross-section of the mating of the male subassembly and female subassembly, the cut taken along the latitudinal axis of the mated subassemblies.

In the same operation, and at approximately the same time male subassembly 110 is inserted into female subassembly 168, rigid floating PCB 122 is received by connector 166. Thus, when subassemblies 110, 168 are engaged, rigid floating PCB 122 and connector 166 also are engaged at or near the same time, thus forming standard buckle 179. When rigid floating PCB 122 and connector 166 are engaged, an electrical connection is formed therebetween, and a complete circuit is formed such that an electronic device such as a radio on one side of the buckle may be in electrical communication with a power source on the other side of the buckle. FIG. 16 is an enlarged view of the bottom portion of female subassembly 168 when it is engaged with male subassembly 110. FIGS. 17 and 18 are cross-sectional views of the same engagement, wherein the views are taken along the longitudinal and latitudinal axes, respectively, of engaged subassemblies 110, 168.

To disconnect standard buckle 179 as illustrated in FIGS. 15-18, locking elements 114, 115 of male subassembly 110 may be pinched inwards to clear ledges 176, 177 of locking elements 114, 115 of female subassembly 168. At this point, male subassembly 110 may be released from female subassembly 168 and pulled out by force applied to male subassembly 110.

At approximately the same time that male subassembly 110 disengages from female subassembly 168 in the process described above, rigid floating PCB 122 disengages from connector 166. Because rigid floating PCB 122 is mounted to male subassembly 110, and connector 166 is attached within female subassembly 168, when subassemblies 110, 168 are separated, rigid floating PCB 122 remains attached to male subassembly 110, and connector 166 stays attached within female subassembly 168. Rigid floating PCB 122 is removed from within connector 166 when subassemblies 110, 168 are disengaged.

Figure 19:
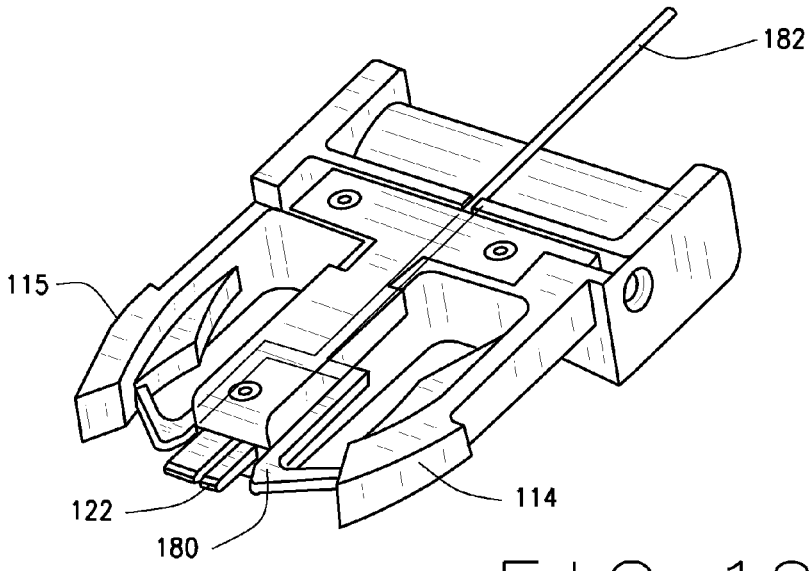
FIG. 19 is a perspective view of a male subassembly modified to be able to be used in a quick release embodiment.

An alternative embodiment to standard buckle 179 described herein is further contemplated, as illustrated in FIG. 19. That alternative embodiment involves some modifications to turn standard buckle 179 into a quick release capable buckle. In that embodiment, the male subassembly further includes a release actuator 180 in contact with locking elements 114, 115. At another end actuator 180 is attached to a cable 182 that may be associated with a cable within reach of the user. When that cable is pulled, cable 182 and resultantly, so is actuator 180. In a manner substantially similar to the manner described for the quick release embodiment, actuator 180 causes locking elements 114, 115 to pinch inward, thus freeing male subassembly 110 from female subassembly 168, and thus rigid floating PCB 122 from connector 166.

While the standard buckle and quick release buckle described herein have been described principally for use with body armor, both embodiments may have applications beyond body armor. For example, buckles may be used to connect electricity or data for devices in backpacks or other carriers used to power a vest or other article. The buckles may be used where any need for an electrical or data connection between separate elements exists. Those elements may be hardware, such as radios, computers, or batteries, or bags or pockets including the aforementioned hardware.

Moreover, more than one piece of armor may be connected by a buckle of the types described herein. For example, a buckle may be used to connect gauntlet armor with forearm armor, forearm armor with bicep armor, and/or bicep armor with shoulder armor, such that a wearer may be able to control devices via controls near his or her hands. In such an embodiment, a buckle would provide a mechanical means of connecting the armor and also a means for maintaining the electronic and/or data connections therebetween by using the technologies described herein above.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A male subassembly for electrically mating with a female subassembly to form a buckle, the male subassembly comprising:

a base;

at least one outer locking element connected to said base and moveable between an engaged position and a disengaged position with said female subassembly;

a central prong element connected to said base;

a rigid printed circuit board attached to and extending from an end portion of said central prong element, said rigid printed circuit board being in electronic communication with an electronic device; and an actuator operably connected to said at least one outer locking element, said actuator moveable between a first position and a second position, and wherein when said actuator is disposed in said first position, said at least one outer locking element is in said engaged position, and wherein when said actuator is moved to said second position, said at least one outer locking element moves to said disengaged position.

2. The male subassembly of claim 1 further including an upper plate attached to said central prong element for containing one or more printed circuit boards therein, said one or more printed circuit boards being in electrical communication in series with said rigid printed circuit board.

3. The male subassembly of claim 2, wherein said one or more printed circuit boards reside within a cavity of said central prong, and said one or more printed circuit boards include a flexible printed circuit board.

4. The male subassembly of claim 3, said one or more printed circuit boards further including a second rigid printed circuit board, said second rigid printed circuit board being located in a second cavity extending transversely between said cavity and said base, and said second rigid printed circuit board being in electronic communication in series with said flexible printed circuit board, wherein said flexible printed circuit board is disposed in series between said rigid printed circuit board and said second rigid printed circuit board.

5. The male subassembly of claim 4 further including a cable harness, said cable harness being in electronic communication with said second rigid circuit board.

6. The male subassembly of claim 1, said rigid printed circuit board for electrical engagement with a connector attached to a rear portion of said female subassembly, said connector positioned and located such that when said male subassembly is received into said female subassembly, said connector receives said rigid printed circuit board of said male subassembly.

7. The male subassembly of claim 1 further including said actuator being disposed on said central prong and operably connected to said at least one outer locking element, and wherein when said actuator is moved into said second position, said actuator moves said at least one outer locking element toward said central prong element.

8. A buckle system comprising:

a male subassembly and a female subassembly moveable between an engaged condition and a disengaged condition;

said male subassembly comprising:

a base;

at least one outer locking element connected to said base;

a central prong element connected to said base; and a first electronic connection member attached to and extending away from an end portion of said central prong element, wherein said first electronic connection member is in electronic communication with an electronic device; and said female subassembly comprising;

at least one locking slot for receiving said at least one locking element;

a rear portion; and a second electronic connection member attached to the rear portion of said female subassembly, said second electronic connection member being positioned and located to matingly engage with said first electronic connection member when said male subassembly and said female subassembly are disposed in said engaged condition; and wherein said at least one outer locking element, said central prong element and said first electronic connection member are disposed on said male subassembly to be received into an opening of said female subassembly when said male subassembly and said female subassembly are moved into said engaged condition.

9. The buckle system of claim 8 further including an upper plate attached to said central prong element for containing one or more printed circuit boards therein.

10. The buckle system of claim 9 wherein said first electronic connection member is a rigid printed circuit board and said one or more printed circuit boards reside within a cavity of said central prong, and said one or more printed circuit boards include a flexible printed circuit board, said flexible printed circuit board in electronic communication in series with said rigid printed circuit board.

11. The buckle system of claim 10, said one or more printed circuit boards further including a second rigid printed circuit board, said second rigid printed circuit board being located in a second cavity extending transversely between said cavity and said base, and said second rigid printed circuit board being in electronic communication in series with said flexible printed circuit board, and wherein said flexible printed circuit board is disposed in series between said rigid printed circuit board and said second rigid printed circuit board.

12. The buckle system of claim 11 further including a cable harness, said cable harness being in electronic communication with said second rigid circuit board.

13. The buckle system of claim 8 further including an actuator attached to said at least one outer locking element, said actuator including a cable attached thereto, wherein pulling said cable away from said male subassembly causes said at least one outer locking element to flex to place said male subassembly and said female subassembly in said disengaged condition.

14. The buckle system of claim 8 wherein said at least one outer locking element is included on a locking leg and wherein said locking leg is disposed within said female subassembly when male subassembly is received into said female subassembly, and wherein when said male subassembly and said female subassembly are in said engaged condition, a portion of said at least one outer locking element extends away from said central prong and outwardly through said at least one locking slot of said female subassembly.

15. A wearable item of clothing and electronics transport system comprising:

a wearable item of clothing;

a buckle comprising a male subassembly and a female subassembly, said male subassembly and said female subassembly moveable between an engaged condition and a disengaged condition, wherein when in said engaged condition, at least a portion of said male subassembly is received into said female subassembly to effectuate a load carrying connection, wherein at least one of said male subassembly or said female subassembly is coupled to said wearable item of clothing;

said male subassembly comprising a base, at least one outer locking element having an engaged position and a disengaged position, a central prong element, and a first electronic connection member attached to and extending from an end portion of said central prong element, said first electronic connection member being in electronic communication with a first electronic device; and said female subassembly comprising at least one locking slot for receiving said at least one locking element, a rear portion, and a second electronic connection member attached to the rear portion of said female subassembly, said second electronic connection member being positioned and located to matingly engage said first electronic connection member when said male subassembly and said female subassembly are disposed in said engaged condition to place said male subassembly and said female subassembly in electronic communication; and wherein said female subassembly is in electronic communication with a second electronic device.

16. The wearable item of clothing and electronics transport system of claim 15, wherein said male subassembly further comprises an actuator operably connected to said at least one outer locking element, said actuator moveable between a first position and a second position, and wherein when said actuator is disposed in said first position, said at least one outer locking element is in said engaged position, and wherein when said actuator is moved to said second position, said at least one outer locking element moves toward said disengaged position.

17. The wearable item of clothing and electronics transport system of claim 16 further including said actuator being disposed on said central prong, and wherein when said actuator is moved to said second position, said actuator moves said at least one outer locking element toward said central prong element to said disengaged position.

18. The wearable item of clothing and electronics transport system of claim 16 wherein said actuator allows for the quick-release of said buckle to a disengaged condition and and re-engagement of said buckle into said engaged position without damaging said first electronic connection member and said second electronic connection member.

19. The wearable item of clothing and electronics transport system of claim 15, wherein said at least one outer locking element is included on a locking leg and wherein said locking leg is disposed within said female subassembly when male subassembly and said female subassembly are in said engaged condition, and wherein when in said engaged condition, a portion of said at least one outer locking element extends outwardly from said central prong and through said at least one locking slot of said female subassembly.

20. The wearable item of clothing and electronics transport system of claim 15, wherein both said male subassembly and said female subassembly are fixedly connected to said wearable item of clothing and said wearable item of clothing is a vest.

* * * * *